US010781381B2

(12) United States Patent
Wegerer et al.

(10) Patent No.: US 10,781,381 B2
(45) Date of Patent: Sep. 22, 2020

(54) PROCESS FOR HYDROCRACKING WITH SIMPLIFIED RECOVERY

(71) Applicant: UOP LLC, Des Plaines, IL (US)

(72) Inventors: David A. Wegerer, Lisle, IL (US); Hari S. Bajpai, Haryana (IN); Gautam Pandey, Haryana (IN)

(73) Assignee: UOP LLC, Des Plaines, IL (US)

( * ) Notice: Subject to any disclaimer, the term of this patent is extended or adjusted under 35 U.S.C. 154(b) by 70 days.

(21) Appl. No.: 16/019,165

(22) Filed: Jun. 26, 2018

(65) Prior Publication Data

US 2019/0390123 A1 Dec. 26, 2019

(51) Int. Cl.
*C10G 67/06* (2006.01)

(52) U.S. Cl.
CPC ..... *C10G 67/06* (2013.01); *C10G 2300/4081* (2013.01)

(58) Field of Classification Search
CPC ..... C10G 47/00; C10G 47/36; C10G 49/22; C10G 61/06; C10G 67/06
See application file for complete search history.

(56) References Cited

U.S. PATENT DOCUMENTS 4,028,194 A * 6/1977 Boyd ..... B01D 3/4255 203/2
4,822,480 A * 4/1989 Harandi ..... C10G 49/22 208/212
4,898,716 A * 2/1990 Hsia ..... C10G 50/00 196/134
5,453,177 A 9/1995 Goebel
2014/0262938 A1* 9/2014 Bray ..... C10L 1/08 208/17

OTHER PUBLICATIONS

Knunyantsa, "Chemical Encyclopedia", 1988, pp. col. 898, 900.
PCT Search Report for PCT/US2019/038145 dated Oct. 3, 2019.

* cited by examiner

*Primary Examiner* — Prem C Singh
*Assistant Examiner* — Brandi M Doyle
(74) *Attorney, Agent, or Firm* — Paschall & Associates; James C. Paschall

(57) ABSTRACT

A process and apparatus for hydrocracking a distillate stream and provides for separation into product cuts without a separate debutanizer column, a naphtha splitter column or a sponge absorber column. The product cuts include a $C_3$-$C_5$ LPG stream and a heavy naphtha stream which can be useful as a reforming feed stream. Additionally, as few as two heaters that rely on external utilities may be required for reboiling fractionator column bottoms.

17 Claims, 1 Drawing Sheet

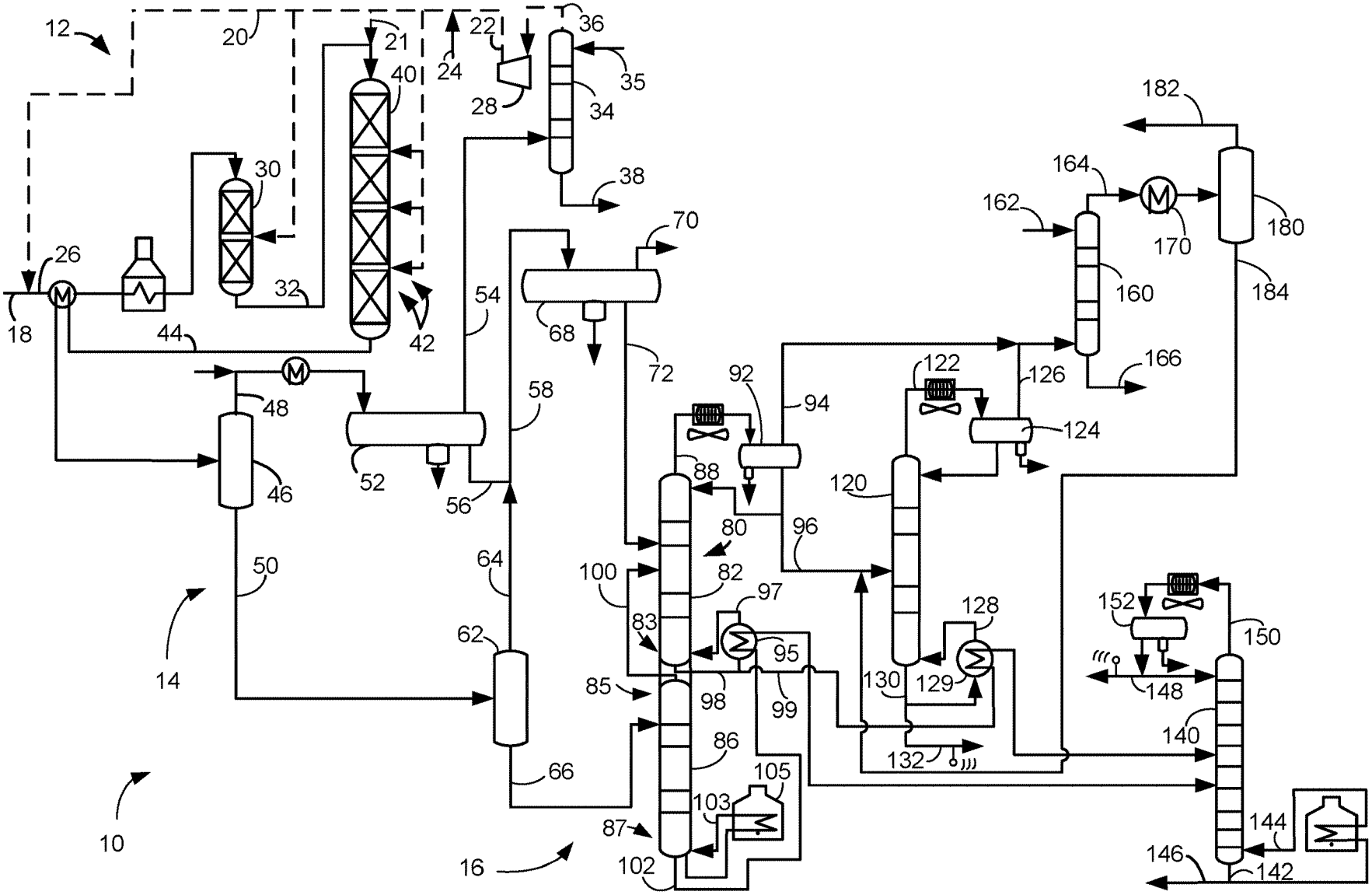
10
12
14
16
18
20
21
22
24
26
28
30
32
34
35
36
38
40
42
44
46
48
50
52
54
56
58
62
64
66
68
70
72
80
82
83
85
86
87
88
92
94
95
96
97
98
99
100
102
103
105
120
122
124
126
128
129
130
132
140
142
144
146
148
150
152
160
162
164
166
170
180
182
184

PROCESS FOR HYDROCRACKING WITH SIMPLIFIED RECOVERY

FIELD

The field is the recovery of hydrocracked hydrocarbon streams, particularly hydrocracked distillate streams.

BACKGROUND

Hydroprocessing can include processes which convert hydrocarbons in the presence of hydroprocessing catalyst and hydrogen to more valuable products. Hydrocracking is a hydroprocessing process in which hydrocarbons crack in the presence of hydrogen and hydrocracking catalyst to lower molecular weight hydrocarbons. Depending on the desired output, a hydrocracking unit may contain one or more beds of the same or different catalyst. Hydrocracking can be performed with one or two hydrocracking reactor stages.

A hydroprocessing recovery section typically includes a series of separators in a separation section to separate gases from liquid materials and cool and depressurize liquid streams to prepare them for fractionation into products. Hydrogen gas is recovered for recycle to the hydroprocessing unit. A typical hydrocracking recovery section comprises six columns. A stripping column strips hydrogen sulfide off of a liquid hydrocracked stream with a steam stream. A liquid overhead stripping stream is fractionated in a deethanizer column whose overhead is sponged along with a vapor stripping overhead stream in an absorber column to produce liquefied petroleum gas (LPG). A product fractionation column separates the stripped liquid hydrocracked stream into an overhead fractionated stream comprising naphtha and a bottoms stream comprising unconverted oil comprising distillate. The product fractionator overhead stream and the deethanizer column bottoms stream are fractionated in a debutanizer fractionation column into a debutanizer overhead stream comprising LPG and a debutanized bottoms stream comprising naphtha. The debutanized bottoms stream is fractionated in a naphtha splitter column into a light naphtha overhead stream and a heavy naphtha bottom stream.

Hydroprocessing recovery sections comprising fractionation columns rely on external utilities that originate from outside of the hydroprocessing unit to provide heater duty to vaporize the fractionation materials. Fractionation sections that rely more on heat generated in the hydroprocessing unit than external utilities are more energy efficient. Typical hydroprocessing recovery sections include a debutanizer column, a sponge absorber column and a naphtha splitter column in addition to other columns.

In some regions, diesel demand is lower than demand for lighter fuel products. Distillate or diesel hydrocracking is proposed for producing the lighter fuel products such as naphtha and LPG. The naphtha product stream may be proposed for a petrochemical production and taken as feed to a reformer unit followed by an aromatics complex.

There is a continuing need, therefore, for improving the efficiency of processes for recovering petrochemical feedstock from hydrocracked distillate stocks.

BRIEF SUMMARY

We have discovered a process and apparatus for hydrocracking a distillate stream and separating it into product cuts without a separate debutanizer column, a naphtha splitter column or a sponge absorber column. The product cuts include a $C_3$-$C_5$ LPG stream and a heavy naphtha stream which can be useful as a reforming feed stream. As few as two heaters that rely on external utilities may be required for reboiling fractionator column bottoms.

BRIEF DESCRIPTION OF THE DRAWING

The FIGURE is a simplified process flow diagram.

DEFINITIONS

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" means that flow from the upstream component enters the downstream component without passing through a fractionation or conversion unit to undergo a compositional change due to physical fractionation or chemical conversion.

The term "bypass" means that the object is out of downstream communication with a bypassing subject at least to the extent of bypassing.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The top pressure is the pressure of the overhead vapor at the vapor outlet of the column. The bottom temperature is the liquid bottom outlet temperature. Overhead lines and bottoms lines refer to the net lines from the column downstream of any reflux or reboil to the column. Stripping columns may omit a reboiler at a bottom of the column and instead provide heating requirements and separation impetus from a fluidized inert media such as steam. Stripping columns typically feed a top tray and take stripped product from the bottom.

As used herein, the term "T5" or "T95" means the temperature at which 5 liquid volume percent or 95 liquid volume percent, as the case may be, respectively, of the sample boils using ASTM D-86 or TBP.

As used herein, the term "external utilities" means utilities that originate from outside of the hydroprocessing unit to typically provide heater duty to vaporize fractionation materials. External utilities may provide heater duty through fired heaters, steam heat exchangers and hot oil heaters.

As used herein, the term "initial boiling point" (IBP) means the temperature at which the sample begins to boil using ASTM D-86 or TBP.

As used herein, the term "end point" (EP) means the temperature at which the sample has all boiled off using ASTM D-86 or TBP.

As used herein, the term "True Boiling Point" (TBP) means a test method for determining the boiling point of a material which corresponds to ASTM D2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "naphtha boiling range" means hydrocarbons boiling in the range of an IBP between about 0° C. (32° F.) and about 100° C. (212° F.) or a T5 between about 15° C. (59° F.) and about 100° C. (212° F.) and the "naphtha cut point" comprising a T95 between about 150° C. (302° F.) and about 200° C. (392° F.) using the TBP distillation method.

As used herein, the term "diesel boiling range" means hydrocarbons boiling in the range of an IBP between about 125° C. (257° F.) and about 175° C. (347° F.) or a T5 between about 150° C. (302° F.) and about 200° C. (392° F.) and the "diesel cut point" comprising a T95 between about 343° C. (650° F.) and about 399° C. (750° F.) using the TBP distillation method.

As used herein, the term "conversion" means conversion of feed to material that boils below the naphtha cut point. The naphtha cut point of the naphtha boiling range is between about 150° C. (302° F.) and about 200° C. (392° F.) using the True Boiling Point distillation method.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator that may be operated at higher pressure.

As used herein, the term "predominant" or "predominate" means greater than 50%, suitably greater than 75% and preferably greater than 90%.

The term "$C_x$" is to be understood to refer to molecules having the number of carbon atoms represented by the subscript "x". Similarly, the term "$C_x$−" refers to molecules that contain less than or equal to x and preferably x and less carbon atoms. The term "$C_x$+" refers to molecules with more than or equal to x and preferably x and more carbon atoms.

As used herein, the term "a component-rich stream" means that the rich stream coming out of a vessel has a greater concentration of the component than the feed to the vessel.

As used herein, the term "a component-lean stream" means that the lean stream coming out of a vessel has a smaller concentration of the component than the feed to the vessel.

DETAILED DESCRIPTION

A proposed process and apparatus for recovering products from hydrocracked distillate comprise a cold stripping column and a hot stripping column, a deethanizer column, a product fractionation column, a chiller and a separator. The product fractionation column produces only two products, an overhead heavy naphtha stream and bottoms unconverted oil (UCO) stream. The debutanizer column and the naphtha splitter column are not required to meet the desired specification for downstream units thereby saving capital and operation expenses. Additionally, a small chiller system is proposed instead of a conventional sponge absorber system to recover LPG from the vaporous overhead streams from the cold stripping column and the deethanizer column. The chiller is located downstream of acid gas absorption to avoid hydrate formation issue in the chiller to enable a lower chiller process outlet temperature for increased LPG recovery.

In the FIGURE, a hydroprocessing unit 10 for hydroprocessing hydrocarbons comprises a hydroprocessing reactor section 12, a separation section 14 and a recovery section 16. The hydroprocessing unit 10 is designed for hydrocracking heavier hydrocarbons into distillate such as kerosene, naphtha and LPG products. For example, a diesel stream in hydrocarbon line 18 and a hydrogen stream in hydrogen line 20 are fed to the hydroprocessing reactor section 12. Hydroprocessed effluent is separated in the separation section 14 and fractionated into products in the recovery section 16.

Hydroprocessing that occurs in the hydroprocessing reactor section 12 may be hydrocracking optionally preceded by hydrotreating. Hydrocracking is the preferred process in the hydroprocessing reactor section 12. Consequently, the term "hydroprocessing" will include the term "hydrocracking" herein.

In one aspect, the process and apparatus described herein are particularly useful for hydrocracking a hydrocarbon feed stream comprising distillate. A suitable distillate stream may include a diesel feed stream boiling in the range of an IBP between about 125° C. (257° F.) and about 175° C. (347° F.) or a T5 between about 150° C. (302° F.) and about 200° C. (392° F.) and a "diesel cut point" comprising a T95 between about 343° C. (650° F.) and about 399° C. (750° F.) using the TBP distillation method. Other feed streams may also be suitable including a vacuum gas oil (VGO), which is typically a hydrocarbon material having a boiling range with an IBP of at least about 232° C. (450° F.), a T5 of about 288° C. (550° F.) to about 343° C. (650° F.), a T95 between about 510° C. (950° F.) and about 570° C. (1058° F.) and an EP of no more than about 626° C. (1158° F.) prepared by vacuum fractionation of atmospheric residue.

The hydrogen stream in the hydrogen line 20 may split off from a hydroprocessing hydrogen line 22. The hydrogen stream in line 20 may be a hydrotreating hydrogen stream. The hydrotreating hydrogen stream may join the hydrocarbon stream in the hydrocarbon line 18 to provide a hydrocarbon feed stream in a hydrocarbon feed line 26. The hydrocarbon feed stream in the hydrocarbon feed line 26 may be heated by heat exchange with a hydrocracked stream in a hydrocracked effluent line 44 and in a fired heater. A heated hydrocarbon feed stream in the hydrocarbon feed line 28 may be fed to an optional hydrotreating reactor 30.

Hydrotreating is a process wherein hydrogen is contacted with hydrocarbon in the presence of hydrotreating catalysts which are primarily active for the removal of heteroatoms, such as sulfur, nitrogen and metals from the hydrocarbon feedstock. In hydrotreating, hydrocarbons with double and triple bonds may be saturated. Aromatics may also be saturated. Consequently, the term "hydroprocessing" may include the term "hydrotreating" herein.

The hydrotreating reactor 30 may be a fixed bed reactor that comprises one or more vessels, single or multiple beds of catalyst in each vessel, and various combinations of hydrotreating catalyst in one or more vessels. It is contemplated that the hydrotreating reactor 30 be operated in a continuous liquid phase in which the volume of the liquid hydrocarbon feed is greater than the volume of the hydrogen gas. The hydrotreating reactor 30 may also be operated in a conventional continuous gas phase, a moving bed or a fluidized bed hydrotreating reactor. The hydrotreating reactor 30 may provide conversion per pass of about 10 to about 30 vol %.

The hydrotreating reactor 30 may comprise a guard bed of specialized material for pressure drop mitigation followed by one or more beds of higher quality hydrotreating catalyst. The guard bed filters particulates and picks up contaminants in the hydrocarbon feed stream such as metals like nickel, vanadium, silicon and arsenic which deactivate the catalyst. The guard bed may comprise material similar to the hydrotreating catalyst. Supplemental hydrogen may be added at an interstage location between catalyst beds in the hydrotreating reactor 30.

Suitable hydrotreating catalysts are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. It is within the scope of the present description that more than one type of hydrotreating catalyst be used in the same hydrotreating reactor 30. The Group VIII metal is typically present in an amount ranging from about 2 to about 20 wt %, preferably from about 4 to about 12 wt %. The Group VI metal will typically be present in an amount ranging from about 1 to about 25 wt %, preferably from about 2 to about 25 wt %.

Preferred hydrotreating reaction conditions include a temperature from about 290° C. (550° F.) to about 455° C. (850° F.), suitably 316° C. (600° F.) to about 427° C. (800° F.) and preferably 343° C. (650° F.) to about 399° C. (750° F.), a pressure from about 2.8 MPa (gauge) (400 psig) to about 17.5 MPa (gauge) (2500 psig), a liquid hourly space velocity of the fresh hydrocarbonaceous feedstock from about 0.1 $hr^{-1}$, suitably 0.5 $hr^{-1}$, to about 5 $hr^{-1}$, preferably from about 1.5 to about 4 $hr^{-1}$, and a hydrogen rate of about 84 $Nm^3/m^3$ (500 scf/bbl), to about 1,250 $Nm^3/m^3$ oil (7,500 scf/bbl), preferably about 168 $Nm^3/m^3$ oil (1,000 scf/bbl) to about 1,011 $Nm^3/m^3$ oil (6,000 scf/bbl), with a hydrotreating catalyst or a combination of hydrotreating catalysts.

The hydrocarbon feed stream in the hydrocarbon feed line 18 may be hydrotreated with the hydrotreating hydrogen stream from hydrotreating hydrogen line 20 over the hydrotreating catalyst in the hydrotreating reactor 30 to provide a hydrotreated stream that exits the hydrotreating reactor 30 in a hydrotreated effluent line 32. The hydrotreated stream still predominantly boils in the boiling range of the feed stream and may be taken as a hydrocracking feed stream. The hydrogen gas laden with ammonia and hydrogen sulfide may be removed from the hydrocracking feed stream in a separator, but the hydrocracking feed stream is suitably fed directly to the hydrocracking reactor 40 without separation. The hydrocracking feed stream may be mixed with a hydrocracking hydrogen stream in a hydrocracking hydrogen line 21 taken from the hydroprocessing hydrogen line 22 and be fed through an inlet to the hydrocracking reactor 40 to be hydrocracked.

Hydrocracking is a process in which hydrocarbons crack in the presence of hydrogen to lower molecular weight hydrocarbons. The hydrocracking reactor 40 may be a fixed bed reactor that comprises one or more vessels, single or multiple catalyst beds 42 in each vessel, and various combinations of hydrotreating catalyst and/or hydrocracking catalyst in one or more vessels. It is contemplated that the hydrocracking reactor 40 may be operated in a continuous liquid phase in which the volume of the liquid hydrocarbon feed is greater than the volume of the hydrogen gas. The hydrocracking reactor 40 may also be operated in a conventional continuous gas phase, a moving bed or a fluidized bed hydrocracking reactor.

The hydrocracking reactor 40 comprises a plurality of hydrocracking catalyst beds 42. If the hydrocracking reactor section 12 does not include a hydrotreating reactor 30, the catalyst beds 42 in the hydrocracking reactor 40 may include hydrotreating catalyst for the purpose of saturating, demetallizing, desulfurizing or denitrogenating the hydrocarbon feed stream before it is hydrocracked with the hydrocracking catalyst in subsequent vessels or catalyst beds 42 in the hydrocracking reactor 40.

The hydrotreated feed stream is hydrocracked over a hydrocracking catalyst in the hydrocracking reactor 40 in the presence of the hydrocracking hydrogen stream from the hydrocracking hydrogen line 21 to provide a hydrocracked stream. A hydrogen manifold may deliver supplemental hydrogen streams to one, some or each of the catalyst beds 42. In an aspect, the supplemental hydrogen is added to each of the hydrocracking catalyst beds 42 at an interstage location between adjacent beds, so supplemental hydrogen is mixed with hydroprocessed effluent exiting from the upstream catalyst bed 42 before entering the downstream catalyst bed 42.

The hydrocracking reactor may provide a total conversion of at least about 20 vol % and typically greater than about 60 vol % of the hydrotreated hydrocarbon stream in the hydrocracking feed line 32 to products boiling below the cut point of the heaviest desired product which is typically diesel or naphtha. The hydrocracking reactor 40 may operate at partial conversion of more than about 30 vol % or full conversion of at least about 90 vol % of the feed based on total conversion. The hydrocracking reactor 40 may be operated at mild hydrocracking conditions which will provide about 20 to about 60 vol %, preferably about 20 to about 50 vol %, total conversion of the hydrocarbon feed stream to product boiling below the desired cut point.

The hydrocracking catalyst may utilize amorphous silica-alumina bases or zeolite bases upon which is deposited a Group VIII metal hydrogenating component. Additional hydrogenating components may be selected from Group VIB for incorporation with the base.

The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and about 14 Angstroms ($10^{-10}$ meters). It is preferred to employ zeolites having a relatively high silica/alumina mole ratio between about 3 and about 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8 and 12 Angstroms, wherein the silica/alumina mole ratio is about 4 to 6. One example of a zeolite falling in the preferred group is synthetic Y molecular sieve.

The natural occurring zeolites are normally found in a sodium form, an alkaline earth metal form, or mixed forms. The synthetic zeolites are nearly always prepared in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water.

Hydrogen or "decationized" Y zeolites of this nature are more particularly described in U.S. Pat. No. 3,130,006.

Mixed polyvalent metal-hydrogen zeolites may be prepared by ion-exchanging with an ammonium salt, then partially back exchanging with a polyvalent metal salt and then calcining. In some cases, as in the case of synthetic mordenite, the hydrogen forms can be prepared by direct acid treatment of the alkali metal zeolites. In one aspect, the preferred cracking bases are those which are at least about 10 wt %, and preferably at least about 20 wt %, metal-cation-deficient, based on the initial ion-exchange capacity. In another aspect, a desirable and stable class of zeolites is one wherein at least about 20 wt % of the ion exchange capacity is satisfied by hydrogen ions.

The active metals employed in the preferred hydrocracking catalysts of the present invention as hydrogenation components are those of Group VIII; i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 wt % and about 30 wt % may be used. In the case of the noble metals, it is normally preferred to use about 0.05 to about 2 wt % noble metal.

The method for incorporating the hydrogenation metal is to contact the base material with an aqueous solution of a suitable compound of the desired metal wherein the metal is present in a cationic form. Following addition of the selected hydrogenation metal or metals, the resulting catalyst powder is then filtered, dried, pelleted with added lubricants, binders or the like if desired, and calcined in air at temperatures of; e.g., about 371° C. (700° F.) to about 648° C. (200° F.) in order to activate the catalyst and decompose ammonium ions. Alternatively, the base component may be pelleted, followed by the addition of the hydrogenation component and activation by calcining.

The foregoing catalysts may be employed in undiluted form, or the powdered catalyst may be mixed and copelleted with other relatively less active catalysts, diluents or binders such as alumina, silica gel, silica-alumina cogels, activated clays and the like in proportions ranging between about 5 and about 90 wt %. These diluents may be employed as such or they may contain a minor proportion of an added hydrogenating metal such as a Group VIB and/or Group VIII metal. Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,178.

By one approach, the hydrocracking conditions may include a temperature from about 290° C. (550° F.) to about 468° C. (875° F.), preferably 343° C. (650° F.) to about 445° C. (833° F.), a pressure from about 4.8 MPa (gauge) (700 psig) to about 20.7 MPa (gauge) (3000 psig), a liquid hourly space velocity (LHSV) from about 0.4 to about 2.5 $hr^{-1}$ and a hydrogen rate of about 421 $Nm^3/m^3$ (2,500 scf/bbl) to about 2,527 $Nm^3/m^3$ oil (15,000 scf/bbl). If mild hydrocracking is desired, conditions may include a temperature from about 315° C. (600° F.) to about 441° C. (825° F.), a pressure from about 5.5 MPa (gauge) (800 psig) to about 13.8 MPa (gauge) (2000 psig) or more typically about 6.9 MPa (gauge) (1000 psig) to about 11.0 MPa (gauge) (1600 psig), a liquid hourly space velocity (LHSV) from about 0.5 to about 2 $hr^{-1}$ and preferably about 0.7 to about 1.5 $hr^{-1}$ and a hydrogen rate of about 421 $Nm^3/m^3$ oil (2,500 scf/bbl) to about 1,685 $Nm^3/m^3$ oil (10,000 scf/bbl).

The hydrocracked stream may exit the hydrocracking reactor 40 in the hydrocracked effluent line 44 and be separated in the separation section 14 in downstream communication with the hydrocracking reactor 40 and optionally the hydrotreating reactor 30. The separation section 14 comprises one or more separators in downstream communication with the hydroprocessing reactor comprising the hydrotreating reactor 30 and/or the hydrocracking reactor 40. The hydrocracked stream in the hydrocracked effluent line 44 may in an aspect be heat exchanged with the hydrocarbon feed stream in the hydrocarbon feed line 26 to be cooled before entering a hot separator 46. The hot separator separates the hydrocracked stream to provide a hydrocarbonaceous, hot vaporous hydrocracked stream in a hot overhead line 48 and a hydrocarbonaceous, hot liquid hydrocracked stream in a hot bottoms line 50. The hot separator 46 may be in downstream communication with the hydrocracking reactor 40. The hot separator 46 operates at about 177° C. (350° F.) to about 371° C. (700° F.) and preferably operates at about 232° C. (450° F.) to about 315° C. (600° F.). The hot separator 46 may be operated at a slightly lower pressure than the hydrocracking reactor 40 accounting for pressure drop through intervening equipment. The hot separator may be operated at pressures between about 3.4 MPa (gauge) (493 psig) and about 20.4 MPa (gauge) (2,959 psig). The hydrocarbonaceous, hot gaseous hydrocracked stream in the hot overhead line 48 may have a temperature of the operating temperature of the hot separator 46.

The hot vaporous hydrocracked stream in the hot overhead line 48 may be cooled before entering a cold separator 52. As a consequence of the reactions taking place in the hydrocracking reactor 40 wherein nitrogen, chlorine and sulfur are removed from the feed, ammonia and hydrogen sulfide are formed. At a characteristic sublimation temperature, ammonia and hydrogen sulfide will combine to form ammonium bisulfide and ammonia, and chlorine will combine to form ammonium chloride. Each compound has a characteristic sublimation temperature that may allow the compound to coat equipment, particularly heat exchange equipment, impairing its performance. To prevent such deposition of ammonium bisulfide or ammonium chloride salts in the hot overhead line 48 transporting the hot vaporous hydrocracked stream, a suitable amount of wash water may be introduced into the hot overhead line 48 upstream of a cooler at a point in the hot overhead line 48 where the temperature is above the characteristic sublimation temperature of either compound.

The hot vaporous hydrocracked stream may be separated in the cold separator 52 to provide a cold vaporous hydrocracked stream comprising a hydrogen-rich gas stream in a cold overhead line 54 and a cold liquid hydrocracked stream in a cold bottoms line 56. The cold separator 52 serves to separate hydrogen rich gas from hydrocarbon liquid in the hydrocracked stream for recycle to the hydrocracking reactor 40 in the cold overhead line 54. The cold separator 52, therefore, is in downstream communication with the hot overhead line 48 of the hot separator 46 and the hydrocracking reactor 40. The cold separator 52 may be operated at about 100° F. (38° C.) to about 150° F. (66° C.), suitably about 115° F. (46° C.) to about 145° F. (63° C.), and just below the pressure of the hydrocracking reactor 40 and the hot separator 46 accounting for pressure drop through intervening equipment to keep hydrogen and light gases in the overhead and normally liquid hydrocarbons in the bottoms.

The cold separator 52 may be operated at pressures between about 2 MPa (gauge) (300 psig) and about 20 MPa (gauge) (2,901 psig). The cold separator 52 may also have a boot for collecting an aqueous phase. The cold hydrocracked stream in the cold bottoms line 56 may have a temperature of the operating temperature of the cold separator 52.

The cold vaporous hydrocracked stream in the cold overhead line 54 is rich in hydrogen. Thus, hydrogen can be recovered from the cold gaseous stream. The cold gaseous stream in the cold overhead line 54 may be passed through a trayed or packed recycle absorption column 34 where it is scrubbed by means of an absorbent liquid such as an aqueous solution fed by line 35 to remove acid gases including hydrogen sulfide and carbon dioxide by absorbing them into the aqueous solution. Preferred aqueous solutions include lean amines such as alkanolamines, diethanolamine, monoethanolamine, and methyldiethanolamine. Other amines can be used in place of or in addition to the preferred amines. The lean amine contacts the cold vaporous stream and absorbs acid gas contaminants such as hydrogen sulfide and carbon dioxide. The resultant "sweetened" cold vaporous hydrocracked stream is taken out from an overhead outlet of the recycle absorption column 34 in a recycle absorption overhead line 36, and a rich amine is taken out from the bottoms at a bottom outlet of the recycle absorption column in a recycle absorption bottoms line 38. The spent absorbent liquid from the bottoms may be regenerated and recycled back (not shown) to the recycle absorption column 34 in line 35.

The absorbed hydrogen-rich stream emerges from the absorption column 34 via the recycle absorption overhead line 36 and may be compressed in a recycle compressor 28 to provide a recycle hydrogen stream in line 22. The recycle hydrogen stream in line 22 may be supplemented with a make-up hydrogen stream in the make-up line 24 to provide the hydrogen stream in hydrogen line 20. A portion of the recycle hydrogen stream in line 22 may be routed to the intermediate catalyst bed outlets in the hydrotreating reactor 30 and the hydrocracking reactor 40 to control the inlet temperature of the subsequent catalyst bed (not shown). The recycle absorption column 34 may be operated with a gas inlet temperature between about 38° C. (100° F.) and about 66° C. (150° F.) and an overhead pressure of about 3 MPa (gauge) (435 psig) to about 20 MPa (gauge) (2900 psig).

The hydrocarbonaceous hot liquid hydrocracked stream in the hot bottoms line 50 may be fractionated as a hot hydrocracked liquid stream in the recovery section 16. In an aspect, the hot liquid hydrocracked stream in the hot bottoms line 50 may be let down in pressure and flashed in a hot flash drum 62 to provide a flash hot vaporous hydrocracked stream of light ends in a hot flash overhead line 64 and a flash hot liquid hydrocracked stream in a hot flash bottoms line 66. The hot flash drum 62 may be any separator that splits the hot liquid hydrocracked stream into vapor and liquid fractions. The hot flash drum 62 may be in direct, downstream communication with the hot bottoms line 50 and in downstream communication with the hydrocracking reactor 40. The hot flash drum 62 may be operated at the same temperature as the hot separator 46 but at a lower pressure of between about 1.4 MPa (gauge) (200 psig) and about 6.9 MPa (gauge) (1000 psig), suitably no more than about 3.8 MPa (gauge) (550 psig). The flash hot liquid hydrocracked stream in the hot flash bottoms line 66 may be further fractionated in the recovery section 16. The flash hot liquid hydrocracked stream in the hot flash bottoms line 66 may have a temperature of the operating temperature of the hot flash drum 62.

In an aspect, the cold liquid hydrocracked stream in the cold bottoms line 56 may be fractionated as a cold hydrocracked stream in the recovery section 16. In a further aspect, the cold liquid hydrocracked stream may be let down in pressure and flashed in a cold flash drum 68 to separate the cold liquid hydrocracked stream in the cold bottoms line 56. The cold flash drum 68 may be any separator that splits hydrocracked stream into vapor and liquid fractions. The cold flash drum 68 may be in direct downstream communication with the cold bottoms line 56 of the cold separator 52 and in downstream communication with the hydrocracking reactor 40.

In a further aspect, the flash hot hydrocracked stream in the hot flash overhead line 64 may be fractionated as a hydrocracked stream in the recovery section 16. In a further aspect, the flash hot vaporous hydrocracked stream may be cooled and also separated in the cold flash drum 68. The cold flash drum 68 may separate the cold liquid hydrocracked stream in the cold bottoms line 56 and/or the flash hot vaporous hydrocracked stream in the hot flash overhead line 64 to provide a flash cold vaporous hydrocracked stream in a cold flash overhead line 70 and a flash cold liquid hydrocracked stream in a cold flash bottoms line 72. In an aspect, light gases such as hydrogen sulfide are stripped from the flash cold liquid hydrocracked stream. Accordingly, a stripping column 80 may be in downstream communication with the cold flash drum 68 and the cold flash bottoms line 72. The cold flash drum 68 may be in downstream communication with the cold bottoms line 56 of the cold separator 52, the hot flash overhead line 64 of the hot flash drum 62 and the hydrocracking reactor 40. The cold liquid hydrocracked stream in cold bottoms line 56 and the flash hot vaporous stream in the hot flash overhead line 64 may enter into the cold flash drum 68 either together or separately. In an aspect, the hot flash overhead line 64 joins the cold bottoms line 56 and a cold flash feed line 58 feeds the flash hot vaporous stream and the cold liquid hydrocracked stream together to the cold flash drum 68.

The cold flash drum 68 may be operated at the same temperature as the cold separator 52 but typically at a lower pressure of between about 1.4 MPa (gauge) (200 psig) and about 6.9 MPa (gauge) (1000 psig) and preferably between about 3.0 MPa (gauge) (435 psig) and about 3.8 MPa (gauge) (550 psig). A flashed aqueous stream may be removed from a boot in the cold flash drum 68. The flash cold liquid hydrocracked stream in the cold flash bottoms line 72 may have the same temperature as the operating temperature of the cold flash drum 68. The flash cold vaporous hydrocracked stream in the cold flash overhead line 70 may contain substantial hydrogen that may be further recovered.

The recovery section 16 may include the stripping column 80, a light fractionation column 120 and a product fractionation column 140. The stripping column 80 may be in downstream communication with a bottoms line in the separation section 14 for stripping volatiles from the hydrocracked streams. For example, the stripping column 80 may be in downstream communication with the hot bottoms line 50, the hot flash bottoms line 66, the cold bottoms line 56 and/or the cold flash bottoms line 72. In an aspect, the stripping column 80 may be a vessel that contains a cold stripping column 82 and a hot stripping column 86 with a wall that isolates each of the stripping columns 82, 86 from the other. The cold stripping column 82 may be in downstream communication with the hydrocracking reactor 40, the cold bottoms line 56 and, in an aspect, the cold flash bottoms line 72 for stripping the cold hydrocracked liquid stream which may be the flash cold hydrocracked liquid stream. The hot stripping column 86 may be in downstream communication with the hydrocracking reactor 40, the hot bottoms line 50 and, in an aspect, the hot flash bottoms line 66 for stripping the hot liquid hydrocracked stream which is hotter than the cold liquid hydrocracked stream by at least 25° C. and preferably at least 50° C. In an aspect, the cold liquid hydrocracked stream may be the flash cold liquid hydrocracked stream in the cold flash bottoms line 72.

The stripping columns 82 and 86 operate at high pressure to maintain $C_{6+}$ hydrocarbons in the stripped stream and stripping the predominance of hydrogen sulfide and other acid gases into the overhead. The flash cold liquid hydrocracked stream in the cold flash bottoms line 72 may be heated and fed to the cold stripping column 82 at an inlet which may be in a top half of the column. The cold liquid hydrocracked stream that may be a flash cold liquid hydrocracked stream which comprises at least a portion of the hydrocracked stream in the hydrocracked effluent line 44 may be stripped in the cold stripping column 82 to provide a cold stripping overhead stream of $C_{5-}$ hydrocarbons, hydrogen, hydrogen sulfide and other gases in a cold stripping overhead line 88 and a cold stripped stream in a cold stripped bottoms line 98 sourced from the separation section 14. The cold stripping overhead stream may be condensed and separated in a receiver 92. A vaporous stripping overhead line 94 from the receiver 92 carries a vaporous stripping overhead stream comprising LPG and light gases. Unstabilized liquid naphtha from the bottoms of the receiver 92 may be split between a reflux portion refluxed to the top of the cold stripping column 82 and a liquid stripping overhead stream which may be transported in a liquid overhead line 96 to a light fractionation column 120. A sour water stream may be collected from a boot of the receiver 92.

The cold stripping column 82 may be operated with a bottoms temperature between about 149° C. (300° F.) and about 288° C. (550° F.), preferably no more than about 260° C. (500° F.), and an overhead pressure of about 0.35 MPa (gauge) (50 psig), preferably no less than about 0.70 MPa (gauge) (100 psig), to no more than about 2.0 MPa (gauge) (290 psig). The temperature in the receiver 92 ranges from about 38° C. (100° F.) to about 66° C. (150° F.) and the pressure is essentially the same as in the overhead of the cold stripping column 82.

A reboil stream in a cold reboil line 97 taken from the cold stripped stream in the cold stripped bottoms line 98 and/or a bottom 83 of the cold stripping column 82 may be boiled up in a reboiler 95 and returned to the cold stripping column to provide heat to the column 82. This is in alternative to inputting a hot stripping media stream such as steam to the column 82 which avoids dew point concerns in the overhead and avoids the additional equipment needed for steam transport and water recovery. A cold net stripped stream in a cold net stripped bottoms line 99 may comprise the predominance of $C_{6+}$ naphtha in the cold liquid hydrocracked stream fed to the cold stripping column 82 in the cold flash bottoms line 72. Consequently, the cold net stripped stream in cold net stripped bottoms line 99 may be cooled by heat exchange in a heat exchanger 129 with a reboil stream in a reboil line 128 and fed to a product fractionation column 140.

The flash hot liquid hydrocracked stream in the hot flash bottoms line 66 may be stripped in the hot stripping column 86 to provide a hot stripping overhead stream of $C_{5-}$ naphtha, hydrogen, hydrogen sulfide and other gases in a hot stripping overhead line 100 and a hot stripped stream in a hot stripped bottoms line 102 sourced from the separation section 14. The hot stripping overhead line 100 may be condensed and a portion refluxed to the hot stripping column 86. However, in an embodiment of the FIGURE, the hot stripping stream in the hot stripping overhead line 100 from the overhead of the hot stripping column 86 may be fed into the cold stripping column 82 directly in an aspect without first condensing or refluxing. The inlet for the cold flash bottoms line 72 carrying the flash cold liquid hydrocracked stream may be at a higher elevation than the inlet for the hot stripping overhead line 100 or they may be mixed and fed to the same inlet to the cold stripping column 82. The hot stripping column 86 may be operated with a bottoms temperature between about 160° C. (320° F.) and about 360° C. (680° F.) and an overhead pressure of about 0.35 MPa (gauge) (50 psig), preferably about 0.70 MPa (gauge) (100 psig), to about 2.0 MPa (gauge) (292 psig).

A hot reboil stream in a hot reboil line 103 which may be taken from the hot stripped stream in the hot stripped bottoms line 102 and/or from a bottom 87 of the hot stripping column 86 may be boiled up in a reboiler 105 and returned to the hot stripping column 86 to provide heat to the column. This is in alternative to inputting a hot stripping media stream such as steam to the hot stripping column 86 which avoids dew point concerns in the overhead and avoids the additional equipment needed for steam transport and water recovery. As shown in the FIGURE, a hot stripped stream in a hot stripped bottoms line 102 may comprise the predominance of $C_{6+}$ naphtha in the flash hot liquid hydrocracked stream fed to the hot stripping column 86 in the hot flash bottoms line 66. At least a portion of the hot stripped stream in the hot stripped bottoms line 102 may be fed to the product fractionation column 140. Consequently, the product fractionation column 140 may be in downstream communication with the hot stripped bottoms line 102 of the hot stripping column 86. The hot stripped stream in the hot stripped bottoms line 102 may be at a hotter temperature than the cold stripped stream in the cold stripped bottoms line 98. In an aspect, the hot stripped stream may be heated and fed to a prefractionation separator that is not shown for separation into a vaporized hot hydroprocessed stream in a prefractionation overhead line and a prefractionation hot liquid hydroprocessed stream in a prefractionation bottoms line and fed to the product fractionation column 140 separately.

In a further aspect, the hot stripped stream in the hot stripped bottoms line 102 from the bottom 87 of the hot stripping column 86 is sufficiently hot to be heat exchanged with the cold reboil stream in the cold reboil line 97 and boil it up to reboil temperature in the heat exchanger 95. The net hot stripped stream will still be at sufficient temperature to enter the product fractionation column 140.

The product fractionation column 140 may be in downstream communication with the cold stripped bottoms line 98 of the cold stripping column 82 and the stripping column 80. The product fractionation column 140 may be in downstream communication with one, some or all of the hot separator 46, the cold separator 52, the hot flash drum 62 and the cold flash drum 68. The product fractionation column 140 may be in downstream communication with the hot stripped bottoms line 102 of the hot stripping column 86. In an aspect, the product fractionation column 140 may comprise more than one fractionation for separating streams into product streams. The product fractionation column 140 may fractionate the cold stripped stream and the hot stripped stream by heat input means of a reboiler instead of by adding an inert stripping media stream such as steam to heat the product fractionation column 140.

The reboiler boils up a reboil stream in a product reboil line 144 taken from the product fractionator bottoms stream in a product fractionator bottoms line 142 and is returned to the column. The product streams from the product fractionation column 140 are minimized when distillate is the feed stock in feed line 18. The product streams may include a net fractionated overhead stream in a net overhead line 148 comprising a predominance of the $C_{6+}$ naphtha in the hydrocracked stream in the hydrocracked effluent line 44 and in the net cold stripped stream in the cold net stripped bottoms line 99 and the hot stripped stream in the hot stripped bottoms line 102. A recycle oil stream comprising distillate comprising an unconverted oil stream may be taken from the product fractionator bottoms line 142 and provided in recycle oil line 146 to the hydrocracking reactor 40 or to a second hydrocracking reactor that is not shown. A fractionated overhead stream in an overhead line 150 may be fully condensed in route to a receiver 152 with a portion of the condensed liquid being refluxed back to the product fractionation column 140. The net fractionated overhead stream in line 148 may be further processed or recovered as naphtha product. This $C_{6+}$ heavy naphtha product may be forwarded to a reformer reactor to prepare aromatic naphtha feed for an aromatics complex. The product fractionation column 140 may be operated with a bottoms temperature between about 260° C. (500° F.), and about 385° C. (725° F.), preferably at no more than about 350° C. (650° F.), and at an overhead pressure between about 7 kPa (gauge) (1 psig) and about 69 kPa (gauge) (10 psig).

The liquid stripping stream in the liquid overhead line 96 contains valuable hydrocarbons that can still be recovered. Hence, it may be transported to a light fractionation column 120 to be fractionated to recover light hydrocarbons in the LPG range. The light fractionation column 120 may be in downstream communication with the cold stripping overhead line 88 of the cold stripping column 82. In an embodiment, the light fractionation column 120 may be a deethanizer column to fractionate the cold liquid stripping stream in the liquid overhead line 96 and a recycle stream in a recycle bottoms line 184 to separate a $C_{2-}$ stream from a $C_{3+}$ hydrocarbon stream. A light fractionated overhead stream in a light fractionator overhead line 122 may be partially condensed and separated in an stripping receiver 124 into a liquid light fractionated overhead stream for reflux to the column 120 and a vaporous light fractionated overhead stream in a vaporous light fractionated overhead line 126. A light fractionated bottoms stream may be withdrawn from a bottom of the light fractionation column 120 in a light bottoms line 130. A reboil stream taken from the light bottoms stream in the light bottoms line 130 may be boiled up in the reboil line 128 and sent back to the light fractionation column to provide heat to the column. This is in alternative to inputting a hot inert media stream such as steam to the column 120 which avoids dew point concerns in the overhead and avoids the additional equipment needed for steam transport and water recovery. The light reboil stream in the light reboil line 128 may be heated by heat exchange in the heat exchanger 129 with the net cold stripped stream in the cold net stripped bottoms line 99 which is hotter than the light reboil stream in the light reboil line 128 and fed back to the light fractionation column 120.

A net light bottoms stream, in an embodiment comprising $C_3$-$C_5$ LPG hydrocarbons is withdrawn in a net light bottoms line 132. The net light bottoms stream contains the predominance of the $C_3$-$C_5$ hydrocarbons from the hydrocracked stream in the hydrocracked effluent line 44 and in the liquid cold stripping stream in the liquid overhead line 96 without need of a sponge absorber column. The light fractionation column 120 may be operated with a bottoms temperature between about 160° C. (320° F.) and about 200° C. (392° F.) and an overhead pressure of about 1 MPa (gauge) (150 psig) to about 2 MPa (gauge) (300 psig).

The vaporous light fractionated overhead stream in the vaporous light fractionated overhead line 126 from the stripping receiver 124 may contain $C_3$-$C_5$ LPG hydrocarbons that can be recovered. The vaporous light fractionated overhead stream in the vaporous light fractionated overhead line 126 may be passed through a trayed or packed light absorption column 160 where it is absorbed by means of an absorbent liquid such as an aqueous solution fed by line 162 to remove acid gases including hydrogen sulfide and carbon dioxide by extracting them into the aqueous solution. The light absorption column 160 may be in downstream communication with the light fractionator overhead line 122 of the light fractionation column 120. Preferred aqueous solutions include lean amines such as alkanolamines, diethanolamine, monoethanolamine, and methyldiethanolamine. Other amines can be used in place of or in addition to the preferred amines. The lean amine contacts the vaporous light fractionated overhead stream and absorbs acid gas contaminants such as hydrogen sulfide and carbon dioxide. The resultant acid gas depleted stream is taken out from an overhead outlet of the light absorption column 160 in an absorber overhead line 164, and a rich amine is taken out from the bottoms at a bottom outlet of the light absorber column in an absorber bottoms line 166. The spent absorbent liquid from the bottoms may be regenerated and recycled back to the light absorption column 160 in line 162 (not shown). The acid gas depleted stream emerges from the light absorption column 160 via the absorber overhead line 164. The light absorption column 160 may be operated with a gas inlet temperature between about 38° C. (100° F.) and about 66° C. (150° F.) and an overhead pressure of about 3 MPa (gauge) (435 psig) to about 20 MPa (gauge) (2900 psig).

The vaporous stripping stream in the vaporous stripping overhead line 94 from the receiver 92 may contain $C_3$-$C_5$ LPG hydrocarbons that can be recovered. The vaporous stripping stream in the vaporous stripping overhead line 94 may be passed through the trayed or packed light absorption column 160 where it is absorbed by means of the absorbent liquid fed by line 162 to remove acid gases including hydrogen sulfide and carbon dioxide by extracting them into the aqueous solution. The lean amine contacts the vaporous stripping stream and absorbs acid gas contaminants such as hydrogen sulfide and carbon dioxide. The resultant acid gas depleted stream is taken out from an overhead outlet of the light absorption column 160 in an absorber overhead line 164, and a rich amine is taken out from the bottoms at a bottom outlet of the light absorption column in an absorber bottoms line 166. The acid gas depleted stream emerges from the light absorption column 160 via the absorber overhead line 164.

Either of the vaporous light fractionated overhead stream in the vaporous light fractionated overhead line 126 or the vaporous stripping stream in the vaporous stripping overhead line 94 or both streams mixed together may be absorbed in the light absorption column 160 to provide the acid gas depleted stream in the absorber overhead line 164. The absorber overhead stream 164 may be sent to a chiller 170 to be chilled to about 4 to about 20° C. to condense $C_3$-$C_5$ LPG hydrocarbons in the acid gas depleted stream in the absorber overhead line 164. The chiller 170 may use cool water as a heat exchange medium. The chiller 170 may be in downstream communication with the light absorption column 160.

The chilled acid gas depleted stream may be separated in an absorber separator 180 to separate an off-gas stream comprising $C_2$– dry gas in an off-gas line 182 and a liquid acid gas depleted stream comprising LPG in a recycle bottoms line 184. The absorber separator 180 may be in downstream communication with light absorption column 160. We have found that by locating the chiller 170 downstream of the light absorption column 160, the absorbed stream can be cooled to a lower temperature without excessive hydrate formation to enable greater recovery of LPG from either of the vaporous light fractionated overhead stream in the vaporous light fractionated overhead line 126 or the vaporous stripping stream in the vaporous stripping overhead line 94. Hence, the chiller 170 is in direct, downstream communication with the absorber overhead line 164 and the absorber separator 180 is in direct, downstream communication with chiller and/or the absorber overhead line.

The LPG liquid acid gas depleted stream may be recycled in the recycle bottoms line 184 to the light fractionation column 120 to produce $C_3$-$C_5$ LPG hydrocarbons in the light fractionated bottoms stream in the light fractionator bottoms line 130 for recovery in the net light bottoms line 132. The liquid acid gas depleted stream may be fed to the light fractionation column 120 with the liquid stripping stream in the liquid overhead line 96. The light fractionation column 120 may be in downstream communication with the absorber separator 180 and particularly with the recycle bottoms line 184.

The process and apparatus 10 can provide a $C_3$-$C_5$ LPG product stream and a $C_6$-$C_{10}$ heavy naphtha product stream at reduced operating expense due to only using slightly more fired heat thus supplanting use of steam for stripping and reboiling. The process and apparatus 10 also requires reduced capital expense due to the omission of a debutanizer column, a naphtha splitter column and sponge absorber column which are conventionally required to obtain LPG and naphtha product streams.

Any of the above lines, units, separators, columns, surrounding environments, zones or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect.

Signals, measurements, and/or data generated or recorded by monitoring components may be transmitted to one or more computing devices or systems. Computing devices or systems may include at least one processor and memory storing computer-readable instructions that, when executed by the at least one processor, cause the one or more computing devices to perform a process that may include one or more steps. For example, the one or more computing devices may be configured to receive, from one or more monitoring components, data related to at least one piece of equipment associated with the process. The one or more computing devices or systems may be configured to analyze the data. Based on analyzing the data, the one or more computing devices or systems may be configured to determine one or more recommended adjustments to one or more parameters of one or more processes described herein. The one or more computing devices or systems may be configured to transmit encrypted or unencrypted data that includes the one or more recommended adjustments to the one or more parameters of the one or more processes described herein.

EXAMPLES

Example 1

We simulated a present process and apparatus for recovering products from hydrocracked distillate comprising a cold stripping column, a hot stripping column, a deethanizer column, a product fractionation column, a chiller and a separator which eliminates the need for a debutanizer column, a naphtha splitter column and a sponge absorber column utilized in a conventional process and apparatus. The present process and apparatus enables a 215 MJ/hr (204 MBtu/hr) reduction in heater duty and elimination of steam requirements resulting in a 70% reduction in operational expense.

Example 2

We also simulated annual cost of using a chiller and a separator as opposed to a sponge absorber column. By use of a chiller instead of a sponge absorber column $410 k a year can be saved in operational expense with only a 0.03 mol % loss in LPG recovery.

Example 3

We further simulated the location of the light absorption column upstream of the chiller to enable further cooling of the vaporous stream to achieve further LPG recovery while staying 6° C. (10° F.) over the hydrate formation temperature to avoid formation of hydrates. Table 1 below shows the conditions and results.

TABLE 1

| | No $H_2S$ Scrubbing before Chiller | $H_2S$ Scrubbing before Chiller |
|---|---|---|
| $H_2S$ at Chiller Inlet (mol/mol) | 9.37 mol % | 49 mol ppm |
| Hydrate formation Temperature, ° C. (° F.) | 16 (60) | 4 (40) |
| Chiller Outlet Temperature, ° C. (° F.) | 21 (70) | 50 (10) |
| Margin over Hydrate Formation, ° C. (° F.) | 6 (10) | 6 (10) |
| LPG Recovery (mol %) | 75.0 | 81.6 |

Scrubbing acid gases before separation enables a lower chiller temperature and a 9 mol % greater recovery of LPG.

SPECIFIC EMBODIMENTS

While the following is described in conjunction with specific embodiments, it will be understood that this description is intended to illustrate and not limit the scope of the preceding description and the appended claims.

A first embodiment of the invention is a process for recovering hydrocracked product comprising hydrocracking a feed stream in a hydrocracking reactor with a hydrogen stream over hydrocracking catalyst to provide a hydrocracked stream; and separating the hydrocracked stream in a separator to provide a vaporous hydrocracked stream and the liquid hydrocracked stream. stripping a liquid hydrocracked stream in a stripping column to provide a stripping stream comprising LPG and a stripped stream; and fractionating the stripping stream in a light fractionation column to provide a fractionated overhead stream and a fractionated bottoms stream; absorbing acid gases from the fractionated overhead stream to provide an absorbed stream; separating the absorbed overhead stream into an offgas stream and a liquid absorbed stream. An embodiment of the invention is one, any or all of prior embodiments in this paragraph up through the first embodiment in this paragraph further comprising recovering in the fractionated bottoms stream a predominance of the $C_3$-$C_5$ hydrocarbons in the hydrocracked stream. An embodiment of the invention is one, any or all of prior embodiments in this paragraph up through the first embodiment in this paragraph further comprising chilling the absorbed stream prior to separation. An embodiment of the invention is one, any or all of prior embodiments in this paragraph up through the first embodiment in this paragraph further comprising recycling the liquid absorbed stream to the fractionation step. An embodiment of the invention is one, any or all of prior embodiments in this paragraph up through the first embodiment in this paragraph further comprising boiling up a reboil portion of the fractionated bottoms stream by heat exchange with the stripped stream. An embodiment of the invention is one, any or all of prior embodiments in this paragraph up through the first embodiment in this paragraph further comprising separating the stripping stream to provide a net vaporous stripping stream and a net liquid stripping stream and the net liquid stripping stream is fractionated in the light fractionation column. An embodiment of the invention is one, any or all of prior embodiments in this paragraph up through the first embodiment in this paragraph further comprising mixing the net vaporous stripping overhead stream and the fractionated overhead stream before absorbing acid gases from the fractionated overhead stream. An embodiment of the invention is one, any or all of prior embodiments in this paragraph up through the first embodiment in this paragraph further comprising fractionating the stripped stream in a product fractionation column to provide a product fractionation overhead stream and a product fractionation bottoms stream. An embodiment of the invention is one, any or all of prior embodiments in this paragraph up through the first embodiment in this paragraph further comprising recovering in the product fractionation overhead stream a predominance of the $C_6$-$C_{10}$ hydrocarbons in the hydrocracked stream. An embodiment of the invention is one, any or all of prior embodiments in this paragraph up through the first embodiment in this paragraph wherein the separator is a cold separator which separates a hot vapor hydrocracked stream from a hot separator and a hot liquid hydrocracked stream from the hot separator is stripped in a hot stripping column to provide a hot stripped stream which is also fractionated in the product fractionation column. An embodiment of the invention is one, any or all of prior embodiments in this paragraph up through the first embodiment in this paragraph, further comprising at least one of sensing at least one parameter of the process and generating a signal or data from the sensing; and generating and transmitting a signal or data.

A second embodiment of the invention is a process for recovering hydrocracked product comprising hydrocracking a feed stream in a hydrocracking reactor with a hydrogen stream over hydrocracking catalyst to provide a hydrocracked stream; and separating the hydrocracked stream in a separator to provide a vaporous hydrocracked stream and the liquid hydrocracked stream. stripping a liquid hydrocracked stream in a stripping column to provide a stripping stream comprising LPG and a stripped stream; and fractionating the stripping stream in a light fractionation column to provide a fractionated overhead stream and a fractionated bottoms stream; absorbing acid gases from the fractionated overhead stream to provide an absorbed stream; chilling the absorbed stream; separating the absorbed overhead stream into an offgas stream and a liquid absorbed stream. An embodiment of the invention is one, any or all of prior embodiments in this paragraph up through the second embodiment in this paragraph further comprising recovering in the fractionated bottoms stream a predominance of the $C_3$-$C_5$ hydrocarbons in the hydrocracked stream. An embodiment of the invention is one, any or all of prior embodiments in this paragraph up through the second embodiment in this paragraph further comprising recycling the liquid absorbed stream to the fractionation step. An embodiment of the invention is one, any or all of prior embodiments in this paragraph up through the second embodiment in this paragraph further comprising separating the stripping stream to provide a net vaporous stripping stream and a net liquid stripping stream and the net liquid stripping stream is fractionated in the light fractionation column. An embodiment of the invention is one, any or all of prior embodiments in this paragraph up through the second embodiment in this paragraph further comprising mixing the net vaporous stripping overhead stream and the fractionated overhead stream before absorbing acid gases from the fractionated overhead stream. An embodiment of the invention is one, any or all of prior embodiments in this paragraph up through the second embodiment in this paragraph further comprising fractionating the stripped stream in a product fractionation column to provide a product fractionation overhead stream and a product fractionation bottoms stream. An embodiment of the invention is one, any or all of prior embodiments in this paragraph up through the second embodiment in this paragraph further comprising recovering in the product fractionation overhead stream a predominance of the $C_6$-$C_{10}$ hydrocarbons in the hydrocracked stream.

A third embodiment of the invention is an apparatus for recovering hydrocracked product comprising a stripping column; a light fractionation column in downstream communication with an overhead line of the stripping column; an absorption column in downstream communication with an overhead line of the light fractionation column; and a separator in downstream communication with the absorption column. An embodiment of the invention is one, any or all of prior embodiments in this paragraph up through the third embodiment in this paragraph further comprising a chiller in downstream communication with the absorption column and the fractionation column is in downstream communication with the separator.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for recovering hydrocracked product comprising:

hydrocracking a feed stream in a hydrocracking reactor with a hydrogen stream over hydrocracking catalyst to provide a hydrocracked stream;

separating said hydrocracked stream in a separator to provide a vaporous hydrocracked stream and said liquid hydrocracked stream;

stripping a liquid hydrocracked stream in a stripping column to provide a stripping stream comprising LPG and a stripped stream;

fractionating said stripping stream in a light fractionation column to provide a fractionated overhead stream and a fractionated bottoms stream;

absorbing acid gases from said fractionated overhead stream to provide an acid gas depleted stream comprising LPG;

chilling said acid gas depleted stream; and separating said acid gas depleted stream into an offgas stream and a liquid acid gas depleted stream comprising LPG.

2. The process of claim 1 further comprising recovering in said fractionated bottoms stream a predominance of the $C_3$-$C_5$ hydrocarbons in the hydrocracked stream.

3. The process of claim 1 further comprising chilling said acid gas depleted stream prior to separation.

4. The process of claim 1 further comprising recycling said liquid acid gas depleted stream to said fractionation step.

5. The process of claim 1 further comprising boiling up a reboil portion of said fractionated bottoms stream by heat exchange with said stripped stream.

6. The process of claim 1 further comprising separating said stripping stream to provide a net vaporous stripping stream and a net liquid stripping stream and the net liquid stripping stream is fractionated in said light fractionation column.

7. The process of claim 6 further comprising mixing said net vaporous stripping overhead stream and said fractionated overhead stream before absorbing acid gases from said fractionated overhead stream.

8. The process of claim 1 further comprising fractionating said stripped stream in a product fractionation column to provide a product fractionation overhead stream and a product fractionation bottoms stream.

9. The process of claim 8 further comprising recovering in said product fractionation overhead stream a predominance of the $C_6$-$C_{10}$ hydrocarbons in the hydrocracked stream.

10. The process of claim 1, further comprising at least one of:

sensing at least one parameter of the process and generating a signal or data from the sensing; and generating and transmitting the signal or data.

11. A process for recovering hydrocracked product comprising:

hydrocracking a feed stream in a hydrocracking reactor with a hydrogen stream over hydrocracking catalyst to provide a hydrocracked stream;

separating said hydrocracked stream in a separator to provide a vaporous hydrocracked stream and said liquid hydrocracked stream;

stripping a liquid hydrocracked stream in a stripping column to provide a stripping stream comprising LPG and a stripped stream;

separating said stripping stream to provide a net vaporous stripping stream and a net liquid stripping stream;

fractionating said net liquid stripping stream in a light fractionation column to provide a fractionated overhead stream and a fractionated bottoms stream;

absorbing acid gases from said fractionated overhead stream to provide an acid gas depleted stream comprising LPG, wherein said net vaporous stripping overhead stream is mixed with said fractionated overhead stream before absorbing acid gases from said fractionated overhead stream;

chilling said acid gas depleted stream; and separating said acid gas depleted stream into an offgas stream and a liquid acid gas depleted stream comprising LPG.

12. The process of claim 11 further comprising recovering in said fractionated bottoms stream a predominance of the $C_3$-$C_5$ hydrocarbons in the hydrocracked stream.

13. The process of claim 11 further comprising recycling said liquid acid gas depleted stream to said fractionation step.

14. The process of claim 11 further comprising fractionating said stripped stream in a product fractionation column to provide a product fractionation overhead stream and a product fractionation bottoms stream.

15. The process of claim 14 further comprising recovering in said product fractionation overhead stream a predominance of the $C_6$-$C_{10}$ hydrocarbons in the hydrocracked stream.

16. The process of claim 9 wherein said separator is a hot separator which separates said hydrocracked stream to provide a hot vaporous hydrocracked stream and a hot liquid hydrocracked stream and said hot liquid hydrocracked stream is stripped in a hot stripping column to provide a hot stripped stream which is also fractionated in said product fractionation column.

17. The process of claim 16 wherein said hot vaporous hydrocracked stream is separated in a cold separator to provide a cold liquid hydrocracked stream which is also fractionated.

* * * * *